United States Patent [19]

Wang et al.

[11] 4,199,065

[45] Apr. 22, 1980

[54] PROCESS FOR RECOVERY OF FINE COAL

[75] Inventors: Samuel S. Wang, Cheshire; Morris E. Lewellyn, Stamford; Eugene L. Smith, Jr., Milford, all of Conn.

[73] Assignee: American Cyanamid Company, Stamford, Conn.

[21] Appl. No.: 897,233

[22] Filed: Apr. 17, 1978

[51] Int. Cl.[2] ..... B03D 1/02

[52] U.S. Cl. ..... 209/166

[58] Field of Search ..... 209/166; 252/61

[56] References Cited

U.S. PATENT DOCUMENTS

| | | | |
|---|---|---|---|
| 1,552,197 | 9/1925 | Bates | 209/166 |
| 2,251,217 | 7/1941 | Woodhouse | 209/166 |
| 2,319,394 | 5/1943 | Erickson | 209/166 X |
| 2,433,258 | 12/1947 | Booth | 209/166 |
| 2,446,207 | 8/1948 | Bishop | 209/166 |
| 3,102,856 | 9/1963 | Chase | 209/167 X |
| 3,394,893 | 7/1968 | Moss | 209/166 X |
| 3,469,693 | 9/1969 | Arbiter | 209/166 |

FOREIGN PATENT DOCUMENTS

| | | | |
|---|---|---|---|
| 56866 | 7/1967 | Poland | 209/166 |

OTHER PUBLICATIONS

Chem. Abst., 66, 1967, 77815g.
Chem. Abst., 79, 1973, 44567a.
Chem. Abst., 74, 1971, 144371x.
Chem. Abst., 78, 1973, 6363c.

*Primary Examiner*—Robert Halper
*Attorney, Agent, or Firm*—William J. van Loo; Frank M. Van Riet

[57] ABSTRACT

Fine coal is recovered with reduced ash content when a bis(alkyl)ester of a sulfosuccinic acid salt is employed as conditioning agent in froth flotation thereof.

17 Claims, No Drawings

PROCESS FOR RECOVERY OF FINE COAL

CROSS-REFERENCE TO RELATED APPLICATIONS

This application is related to Application Ser. No. 897,230, filed on Apr. 17, 1978. The instant application relates to a process of froth flotation, while the related application relates to a composition of a bis(alkyl)ester of a sulfosuccinic acid and a frothing agent.

This invention relates to an improved process for the froth flotation of fine coal. More particularly, this invention relates to such a process wherein a bis(alkyl)ester of a sulfosuccinic acid salt is used as conditioning agent with or without frothing agent to provide high recovery with reduced ash content.

Fine coal resulting from mining operations and having a particle size of about minus 28 mesh is conventionally froth floated for recovery and sulfur removal. In the conventional process, the fine coal is froth floated using a frothing agent alone or a combination of frothing agent and an oil. Although at optimum dosage of frothing agent high recovery of coal is obtained, the amount of ash resulting upon combustion of the recovered coal is higher than desired. This ash content reduces the BTU value of the coal and can contribute to air pollution. Accordingly, there exists the need for an improved process for the froth flotation of fine coal which reduces ash content without sacrifice in coal recovery. The provision for such an improved process would fulfill a long-felt need and constitute a significant advance in the art.

In accordance with the present invention, there is provided a process for recovering fine coal which comprises conditioning an aqueous slurry of fine coal with an effective amount of a bis(alkyl)ester of sulfosuccinic acid salt of the general structure

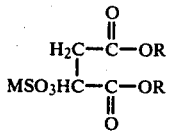

wherein R is a linear or branched chain alkyl group of about 3 to 20 carbon atoms and M is a cation providing a water-soluble salt, and thereafter froth-floating the conditioned slurry to obtain a coal concentrate as the float.

The process of the present invention provides high recovery of coal values and, unexpectedly, reduces the ash content of the recovered coal. The bis(alkyl)ester of sulfosuccinic acid salt may be used alone or in combination with a frother or a frother and an oil.

In carrying out the process of the present invention, an aqueous slurry of fine coal is briefly conditioned with an effective amount of a bis(alkyl)ester of a sulfosuccinic acid salt and the conditioned slurry is then subjected to froth flotation employing standard procedures. The fine coal particles are levitated by the air bubbles forming the froth and are floated from the bulk of the slurry. The coal values are recovered from the froth and further processed to provide combustible material.

The conditioning agent used in accordance with the present invention is a bis(alkyl)ester of sulfosuccinic acid of the general structure

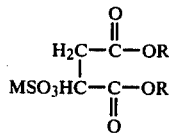

wherein R is a linear or branched chain alkyl group of about 3 to 20 carbon atoms, preferably about 4 to 13 carbon atoms, and M is a cation providing a water-soluble salt, preferably a sodium, potassium or ammonium cation. The effective dosage of the conditioning agent will vary depending upon the source of the fine coal and other factors. Generally, the effective amount will be in the range of about 0.01 to 2.0 pounds per ton of fine coal, preferably about 0.05 to 0.5 pound per ton of fine coal. When used with frother or frother and oil, the conditioning agent can be used to replace a part of the frother normally employed. It can also be used to replace the oil used in conjunction with frother.

The frothers contemplated for use in appropriate embodiments of the present invention are those conventionally employed in froth flotation of fine coal. Such frothers include, for example, alcohols of about 4 to 12 carbon atoms or mixtures thereof, cresylic acids, and polyoxyalkyleneglycol types, a preferred species being a mixture of $C_4$ to $C_8$ alcohols. Useful oils in appropriate embodiments include those based on petroleum or animal and vegetable products. A preferred embodiment involves the use of a combination of about 25 to 50 weight percent of bis(alkyl)ester of a sulfosuccinic acid salt and, correspondingly, about 75 to 50 weight percent of a conventional frother.

The fine coal arises from mining operations as an aqueous slurry of verying coal contents, usually from about 2 to 15 weight percent. Such slurry is conditioned for a brief time period with the bis(alkyl)ester of sulfosuccinic acid salt or combination thereof with frother or frother and oil. Such conditioning may be from a few seconds to a few minutes to ensure uniform distribution throughout the slurry.

After the slurry is properly conditioned, as indicated, it is subjected to conventional froth flotation procedures. In such procedure, air bubbles are introduced into the slurry to form a froth on the surface of the slurry. The air bubbles attach to coal particles and cause them to levitate and become part of the froth, which is continually skimmed from the slurry, thus isolating the desired coal particles from other ingredients in the slurry. The recovered coal is washed, filtered, and dried to provide combustible material of greatly reduced ash content. Topically, the untreated coal particles contain 42% ash, and this content is reduced considerably by the process of the present invention.

The invention is more fully illustrated by the examples which follow, wherein all parts and percentages are by weight unless otherwise specified.

EXAMPLES 1-18

A series of froth flotations were run on a sample of fine coal obtained from a leading processor. The coal particles were minus 28 mesh. Using an 8.0% aqueous suspension of the crude coal of about 10% ash, a comparative run (A) was made using a mixture of $C_4$ to $C_8$ alcohols as frothing agent. A number of bis(alkyl)esters of sulfosuccinic acid, sodium salt were run at the same dosage as frother alone. An additional number of runs were made using a combination of the conventional frother and a bis(alkyl)ester of sulfosuccinic acid, sodium salt.

The various results obtained and details of the runs are given in Table I which follows.

The results show the reduced ash content obtained by the process of the present invention. Such reduction leads to higher BTU values for the coal.

TABLE I

| | | FROTH FLOTATION OF FINE COAL | | | | |
|---|---|---|---|---|---|---|
| Example No. | Frother Identity | Employed Amount[1] | Bis Ester[2] Identity | Employed Amount[1] | Coal Recovery (%) | Ash in Concentrate (%) |
| Comparative | $C_4$-$C_8$ ALCOHOL | 0.2 | — | 0 | 98.06 | 7.12 |
| 1 | — | 0 | Bis(isobutyl) | 0.2 | 97.35 | 7.11 |
| 2 | $C_4$-$C_8$ ALCOHOL | 0.15 | Bis(isobutyl) | 0.05 | 97.84 | 5.91 |
| 3 | $C_4$-$C_8$ ALCOHOL | 0.1 | Bis(isobutyl) | 0.1 | 98.13 | 5.46 |
| 4 | — | 0 | Bis(amyl) | 0.2 | 96.53 | 5.53 |
| 5 | $C_4$-$C_8$ ALCOHOL | 0.15 | Bis(amyl) | 0.05 | 97.99 | 5.71 |
| 6 | $C_4$-$C_8$ ALCOHOL | 0.1 | Bis(amyl) | 0.1 | 97.87 | 5.52 |
| 7 | — | 0 | Bis(hexyl) | 0.2 | 97.10 | 4.97 |
| 8 | $C_4$-$C_8$ ALCOHOL | 0.15 | Bis(hexyl) | 0.05 | 97.69 | 5.83 |
| 9 | $C_4$-$C_8$ ALCOHOL | 0.1 | Bis(hexyl) | 0.1 | 96.84 | 5.76 |
| 10 | — | 0 | Bis(cyclohexyl) | 0.2 | 93.52 | 5.04 |
| 11 | $C_4$-$C_8$ ALCOHOL | 0.15 | Bis(cyclohexyl) | 0.05 | 97.90 | 5.66 |
| 12 | $C_4$-$C_8$ ALCOHOL | 0.1 | Bis(cyclohexyl) | 0.1 | 96.62 | 5.04 |
| 13 | — | 0 | Bis(2-ethylhexyl) | 0.2 | 69.17 | 4.39 |
| 14 | $C_4$-$C_8$ ALCOHOL | 0.15 | Bis(2-ethylhexyl) | 0.05 | 96.66 | 3.60 |
| 15 | $C_4$-$C_8$ ALCOHOL | 0.1 | Bis(2-ethylhexyl) | 0.1 | 95.97 | 5.05 |
| 16 | — | 0 | Bis(isodecyl) | 0.2 | 85.11 | 5.08 |
| 17 | $C_4$-$C_8$ ALCOHOL | 0.15 | Bis(isodecyl) | 0.05 | 97.50 | 5.52 |
| 18 | $C_4$-$C_8$ ALCOHOL | 0.1 | Bis(isodecyl) | 0.1 | 95.46 | 5.27 |

Notes:
[1]Pounds per ton of coal.
[2]Bis(ester) of sulfosuccinic acid, sodium salt.

EXAMPLE 19

A further series of froth flotations were run to demonstrate that the conditioning agents used in the process of the present invention can replace the oil used in conventional frother-oil combinations. The fine coal processed was obtained from a different source than that used in the previous examples. The slurry contained 4.6% crude coal of about 42% ash. In a comparative run (B), the coal slurry was froth-floated using only a $C_4$-$C_8$ alcohol mixture as frother. In another comparative run (C), a mixture of the $C_4$-$C_8$ alcohol frother and No. 2 fuel oil was used to froth-float the coal. In an embodiment of the present invention, bis(tridecyl)sulfosuccinic acid, sodium salt, was used to replace the oil in comparative run (C). Results and details of these runs are given in Table II, which follows.

TABLE II

| | FROTH FLOTATION OF FINE COAL | | | | |
|---|---|---|---|---|---|
| EXAMPLE NO. | FROTHER[1] DOSAGE (lb./ton) | No. 2 FUEL OIL DOSAGE (lb./ton) | BIS(TRIDECYL)[2] ESTER DOSAGE (lb/ton) | RECOVERY (%) | ASH (%) |
| Comparative B | 0.4 | 0 | 0 | 77.61 | 10.06 |
| Comparative C | 0.4 | 1.0 | 0 | 87.72 | 11.21 |
| 19 | 0.4 | 0 | 0.14 | 84.26 | 10.14 |

NOTES:
[1]$C_4$-$C_8$ Alcohol Mixture.
[2]Bis(tridecyl)sulfosuccinic acid, sodium salt.

The results show that a small usage of a bis(alkyl)ester of a sulfosuccinic acid salt effectively replaces a larger quantity of fuel oil.

EXAMPLE 20

The same fine coal slurry source used in Example 19 was employed. In a comparative run (D), the amount of oil used in comparative run (C) was increased. In an embodiment of the invention, a small quantity of the bis(alkyl)ester used in Example 19 was added to combination of frother and fuel oil. Details and results are given in Table III, which follows.

TABLE III

| | FROTH FLOTATION OF FINE COAL | | | | |
|---|---|---|---|---|---|
| EXAMPLE NO. | FROTHER[1] DOSAGE (lb.ton) | NO. 2 FUEL OIL DOSAGE (lb/ton) | BIS(TRIDECYL[2] ESTER DOSAGE (lb/ton) | RECOVERY (%) | ASH (%) |
| Comparative D | 0.4 | 2.0 | 0 | 79.65 | 10.14 |
| 20 | 0.4 | 2.0 | 0.14 | 87.63 | 11.07 |

NOTES:
SEE TABLE II

These results show that the bis(alkyl)ester of sulfosuccinic acid salt can overcome the adverse effects on recovery of excess oil.

We claim:

1. A process for recovering fine coal from its associated ash which comprises conditioning an aqueous slurry of fine coal with an effective amount of a conditioning agent comprising a bis(alkyl)ester of a sulfosuccinic acid salt of the general structure

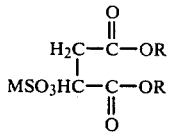

wherein R is a linear, branched or cyclic chain alkyl group of about 4 to 20 carbon atoms and M is a cation providing a water-soluble salt, and thereafter froth-floating the conditioned slurry to obtain a coal concentrate as the float.

2. The process of claim 1 wherein said bis(alkyl)ester of a sulfosuccinic acid salt is the bis(isobutyl)ester of sodium sulfosuccinate.

3. The process of claim 1 wherein said bis(alkyl)ester of a sulfosuccinic acid salt is the bis(amyl)ester of sodium sulfosuccinate.

4. The process of claim 1 wherein said bis(alkyl)ester of a sulfosuccinic acid salt is the bis(hexyl)ester of sodium sulfosuccinate.

5. The process of claim 1 wherein said bis(alkyl)ester of a sulfosuccinic acid salt is the bis(cyclohexyl)ester of sodium sulfosuccinate.

6. The process of claim 1 wherein said bis(alkyl)ester of a sulfosuccinic acid salt is the bis(2-ethylhexyl)ester of sodium sulfosuccinate.

7. The process of claim 1 wherein said bis(alkyl)ester of a sulfosuccinic acid salt is the bis(isodecyl)ester of sodium sulfosuccinate.

8. The process of claim 1 wherein in addition to said bis(ester) of a sulfosuccinic acid salt, there is also employed an effective amount of a frothing agent.

9. The process of claim 8 wherein said frothing agent is a mixture of $C_4$-$C_8$ alcohols.

10. The process of claim 8 wherein said bis(alkyl)ester of a sulfosuccinic acid salt is the bis(isobutyl)ester of sodium sulfosuccinate.

11. The process of claim 8 wherein said bis(alkyl)ester of a sulfosuccinic acid salt is the bis(amyl)ester of sodium sulfosuccinate.

12. The process of claim 8 wherein said bis(slkyl)ester of a sulfosuccinic acid salt is the bis(hexyl)ester of sodium sulfosuccinate.

13. The process of claim 8 wherein said bis(alkyl)ester of a sulfosuccinic acid salt is the bis(cyclohexyl)ester of sodium sulfosuccinate.

14. The process of claim 8 wherein said bis(alkyl)ester of a sulfosuccinic acid salt is the bis(isodecyl)ester of sodium sulfosuccinate.

15. The process of claim 8 wherein said bis(alkyl)ester of a sulfosuccinic acid salt is the bis(2-ethylhexyl)ester of sodium sulfosuccinate.

16. The process of claim 8 wherein in addition to said bis(alkyl)ester of a sulfosuccinic acid salt and said frothing agent, there is also employed an effective amount of an oil.

17. The process of claim 16 wherein said bis(alkyl)ester of a sulfosuccinic acid salt is the bis(tridecyl)ester of sodium sulfosuccinate, the frothing agent is a mixture of $C_4$-$C_8$ alcohols, and said oil is No. 2 fuel oil.

* * * * *